US006117366A

United States Patent [19]

Park et al.

[11] Patent Number: 6,117,366

[45] Date of Patent: Sep. 12, 2000

[54] ELECTRICALLY CONDUCTIVE COMPOSITION INCLUDING METAL PARTICLES

[75] Inventors: Sung-soon Park; Ji-won Lee; Yoon-ho Jun, all of Suwon; Hun-soo Kim, Seoul; Dong-sik Zang, Suwon, all of Rep. of Korea

[73] Assignee: Samsung Display Devices Co., Ltd., Kyungki-Do, Rep. of Korea

[21] Appl. No.: 09/084,964

[22] Filed: May 27, 1998

[30] Foreign Application Priority Data

Jul. 23, 1997 [KR] Rep. of Korea ..... 97-34591

[51] Int. Cl.[7] ..... H01B 1/22

[52] U.S. Cl. ..... 252/512; 252/513; 252/514

[58] Field of Search ..... 252/512, 513, 252/514, 520.1, 520.2, 521.3

[56] References Cited

U.S. PATENT DOCUMENTS 5,306,543 4/1994 Katsen ..... 428/195
5,376,308 12/1994 Hirai et al. ..... 252/518
5,785,897 7/1998 Toufuku et al. ..... 252/514
5,840,364 11/1998 Takeda et al. ..... 427/160
5,861,112 1/1999 Watanabe et al. ..... 252/519.1

*Primary Examiner*—Mark Kopec
*Attorney, Agent, or Firm*—Leydig, Voit & Mayer, Ltd.

[57] ABSTRACT

A composition for a transparent conductive layer, a transparent conductive layer formed of the composition, and a method for forming the transparent conductive layer. The composition comprises a metal ($M_1$) particle, a binding agent and a solvent, wherein the metal ($M_1$) particle has an average particle diameter of 10~30 nm and is at least one selected from the group consisting of gold (Au), silver (Ag), platinum (Pt), copper (Cu), nickel (Ni), lead (Pb), cobalt (Co), rhodium (Rh), ruthenium (Ru), palladium (Pd) and tin (Sn), and wherein the binding agent is at least one compound selected from the group consisting of polypyrrole, polyvinylpyrrolidone, polyvinylalcohol and silicon alkoxide oligomer. Therefore, the transparent conductive layer which is excellent in conductivity and transmittance can be formed by a low-temperature sintering process.

23 Claims, 2 Drawing Sheets

ELECTRICALLY CONDUCTIVE COMPOSITION INCLUDING METAL PARTICLES

BACKGROUND OF THE INVENTION

1. Field of the Invention

The present invention relates to a conductive composition, a transparent conductive layer formed of the composition, and a method for forming the transparent conductive layer, and more particularly, to a conductive composition used for forming a power supplying transparent electrode of a display device and an electromagnetic wave shielding layer of home appliances, and a method for forming a transparent conductive layer using the composition, and a transparent conductive layer formed by the method.

2. Description of the Prior Art

A transparent conductive layer for shielding electromagnetic waves of a display device is formed by a wet coating method. That is, a composition containing transparent conductive particles such as indium tin oxide (ITO) and antimony tin oxide (ATO) is coated by the wet coating method, e.g., spin coating, spray coating and deposition coating, and then a sintering is performed at a low temperature, resulting in the transparent conductive layer.

A transparent conductive layer formed by the above method has a sheet resistance of $10^4$~$10^5$ Ω/□. Thus, this transparent conductive layer can be applied to a 17-inch monitor, satisfying the restriction on the electromagnetic wave by the Swedish Confederation of Professional Employees (TCO). However, according to the restriction on the electromagnetic wave by the TCO, a large monitor of 17" or more requires the sheet resistance which is less than $10^3$ Ω/□. Thus, it is impossible to apply the transparent conductive layer formed by the conventional method to the 17" or more monitor.

Thus, in order to improve the conductivity of the transparent conductive layer, a method has been suggested a method in which a fine particle type pigment is used and a high-temperature sintering is performed. According to this method, the conductivity of the transparent conductive layer can be slightly improved. However, the improvement is not satisfactory. Also, due to its high-temperature sintering process, it is impossible to apply this method to a substrate having a poor heat-resistance. In addition, in a case where the transparent conductive layer is applied to a cathode ray tube (CRT), the CRT itself may be damaged.

SUMMARY OF THE INVENTION

To solve the above problems, it is an object of the present invention to provide a conductive composition, capable of forming a transparent conductive layer having good conductivity and transmittance.

It is another object of the present invention to provide a method for forming a transparent conductive layer using the composition.

It is still another object of the present invention to provide a transparent conductive layer formed by the above method.

Accordingly, to achieve the above first object, there is provided a conductive composition comprises a metal ($M_1$) particle, a binding agent and a solvent, wherein the metal ($M_1$) particle has an average particle diameter of 10~30 nm and is at least one selected from the group consisting of gold (Au), silver (Ag), platinum (Pt), copper (Cu), nickel (Ni), lead (Pb), cobalt (Co), rhodium (Rh), ruthenium (Ru), palladium (Pd) and tin (Sn), and wherein the binding agent is at least one compound selected from the group consisting of polypyrrole, polyvinylpyrrolidone, polyvinylalcohol and a silicon alkoxide oligomer.

To achieve the second object, there is provided a method for forming a transparent conductive layer, comprising the steps of:

(a) depositing a conductive composition comprising a metal ($M_1$) particle, a binding agent and at least one solvent on a substrate, and drying the resultant; and (b) heating the resultant to form a conductive layer, wherein the metal ($M_1$) particle has an average particle diameter of 10~30 nm and is at least one selected from the group consisting of gold (Au), silver (Ag), platinum (Pt), copper (Cu), nickel (Ni), lead (Pb), cobalt (Co), rhodium (Rh), ruthenium (Ru), palladium (Pd) and tin (Sn), and wherein the binding agent is at least one compound selected from the group consisting of polypyrrole, polyvinylpyrrolidone, polyvinylalcohol and silicon alkoxide oligomer.

To achieve the third object, there is provided a transparent conductive layer has transmittance of 70~80% and a sheet resistance of 100~2,000 Ω/□ by forming the above method.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENT

A conductive composition according to the present invention includes a metal ($M_1$) particle, a binding agent and a solvent. The metal ($M_1$) particle has an average particle diameter of 10~30 nm, and is selected from the group consisting of gold (Au), silver (Ag), platinum (Pt), copper (Cu), nickel (Ni), lead (Pb), cobalt (Co), rhodium (Rh), ruthenium (Ru), palladium (Pd) and tin (Sn).

The binding agent is at least one compound selected from the group consisting of polypyrrole, polyvinylpyrrolidone, polyvinylalcohol and silicon alkoxide oligomer. Here, the silicon alkoxide oligomer is represented by the following formula (1).

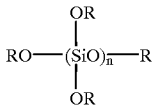

(1)

where R is alkyl group and n is an integer between 2 and 10.

When the above binding agent is used, the agent and the metal particles form a transparent conductive layer with porous network structure.

The composition may further include a metal oxide such as indium tin oxide (ITO), tin oxide ($SnO_2$), indium oxide ($In_2O_3$), titanium oxide ($TiO_2$), antimony tin oxide (ATO), silicon oxide ($SiO_2$) and zirconium oxide ($ZrO_2$). If metal oxides such as these are used, there is improvement in refractive index and hardness of the transparent conductive layer.

Figure 1:
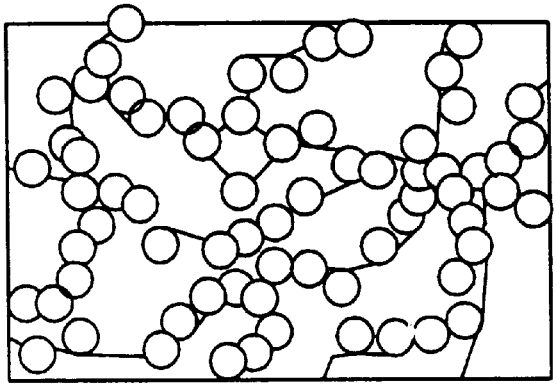
FIG. 1 is a diagram illustrating a state where metal particles are connected like a chain in a transparent conductive layer.

The conductivity of the conductive layer formed of metal particles is increased when the metal particles sufficiently contact each other. If the contact between the metal particles is not good, that is, if the metal particles cohere each other to form isolated clusters, the conductivity of the layer can decrease. However, if the content of the metal particles is large enough to form a compact structured layer without pores, the transmittance of the layer will be is decreased while the conductivity of the layer is improved. Thus, in order to form a conductive layer which has higher transmittance, it is preferable to form a conductive layer with chain network structure by causing the metal particles to connect in a chain shape as shown in FIG. 1.

According to the present invention, the metal particles can connect like a chain and can improve the dispersion of the metal particles to the maximum level. Further, a binding agent such as polyprrole, polyvinylpyrrolidone, polyvinylalcohol and silicon alkoxide oligomer which is represented by the formula (1) is used.

Figure 2:
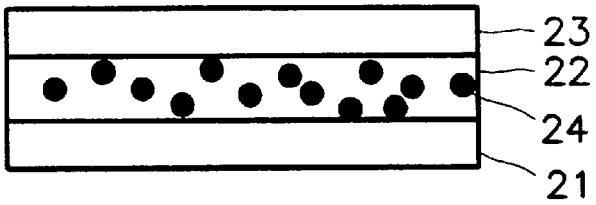
FIGS. 2 and 3 are schematic view of a transparent conductive layer according to the present invention.

The transparent conductive layer of the present invention has the structure as shown in FIG. 2.

Referring to FIG. 2, a conductive layer 22 containing metal particles 24 is formed on a substrate 21, and a silica protection layer 23 is formed on the conductive layer 22. Here, the silica protective layer 23, which is made of a hydrolyzed product of the silicon alkoxide, can be used to improve the hardness and stability of the transparent conductive layer.

Figure 3:
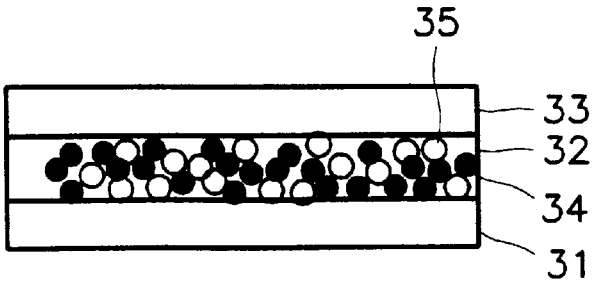

As shown in FIG. 3, the conductive layer 22 may further include metal oxide particles 35 other than the metal particles 34. Here, the mixing ratio of the metal particles and the metal oxide particles is 2.5:1~30:1. If the metal oxide particles are contained in the conductive layer, the hardness, refractive index and reflectivity of the transparent conductive layer can be controlled to a preferable range.

The binding agent which can improve the dispersion and binding properties of the metal particles, is selected from the group consisting of polypyrrole, polyvinylpyrrolidone, polyvinylalcohol and a silicon alkoxide oligomer. If such binding agents such as these are used, the metal particles are bound continuously. That is, the metal particles form a cluster like a chain, so that the conductivity of the conductive layer is improved. Also, due to the gap, that is, pores formed between the chains, the transmittance of the conductive layer is also improved. Preferably, the mixing ratio of the binding agent and the metal particles is between 1:10 and 1:1.82.

In the transparent conductive layer according to the present invention, it is very important to properly control the thicknesses of the conductive layer and the protection layer.

Figure 4:
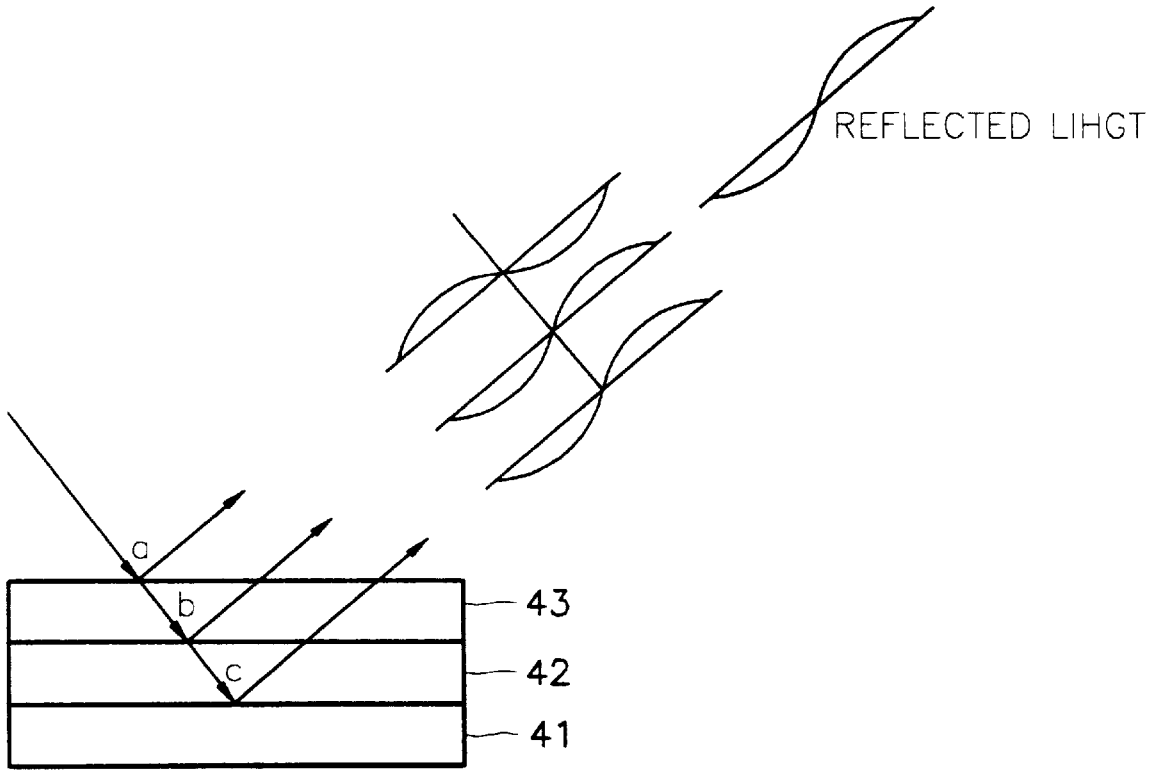
FIG. 4 is a diagram showing the waveforms of a light reflected from each layer of a transparent conductive layer according to the present invention.

Preferably, the conductive layer having a high refractive index with respect to an incident light is 50~400 nm in thickness, and the thickness of the protection layer having a low refractive index is determined as $\lambda/4$ of the wavelength of the incident light. As shown in FIG. 4, waveforms b and c are reflected being crossed with the waveform a as much as $\lambda/2$, so that interference by the reflected light occurs, thereby decreasing the amplitude of the whole reflected light. As a result, the protective layer acts as an anti-reflective layer and the eye strain of a viewer is decreased.

In FIG. 4, reference numeral 41 represents a substrate, reference numeral 42 represents a conductive layer and reference numeral 43 represents a protection layer, respectively.

Hereinafter, a method for forming a transparent conductive layer according to the present invention will be described.

First, a conductive composition containing a metal ($M_1$) particle, a binding agent and a solvent are deposited on the substrate 41. Here, a step of pre-heating the substrate prior to coating the composition on the substrate 41 may be omitted.

Preferably, the content of the metal particles is 0.2~1.0 wt % based on the total weight of the conductive composition. Here, if the content of the metal particles exceeds 1.0 wt %, the transmittance is lowered while the conductivity of the layer is good. Meanwhile, if the content of the metal particles is less than 0.2 wt %, the conductivity may deteriorate.

Preferably, the content of the binding agent is 0.0333~0.332 wt % based on the total weight of the conductive composition. Here, if the content of the binding agent is less than 0.0333 wt %, film quality may deteriorate. If the content of the binding agent exceeds 0.332 wt %, the binding agent may disturb the connection of the metal particles to lower the conductivity of the film.

Then, a composition containing hydrolytes of the metal alkoxide [$M_2(OR)_4$], is coated on the conductive layer. Here, the metal alkoxide [$M_2(OR)_4$] is at least one selected from the group consisting of $Si(OR)_4$, $Ti(OR)_4$, $Sn(OR)_4$ and $Zr(OR)_4$, where R is $C_1$~$C_4$ alkyl group. Then, the resultant is dried and then heated at 150~250° C.

According to the above-described method, a conductive transparent layer having 70~80% of transmittance and 100~2,000 Ω/□ of sheet resistance is obtained.

The present invention will be described in detail referring to the following examples. However, the present invention is not limited to the following examples.

EXAMPLE 1

0.25 g of polyvinylpyrrolidone solution, which was obtained by dissolving 22 g of polyvinylpyrrolidone in 78 g of pure water, 70 g of methanol, 55 g of 2-methoxyethanol, and 10 g of propyleneglycol monomethylether (PGM) were mixed and stirred for 1 hour. Then, 0.45 g of silver (Ag)

particles with 20 nm in average particle diameter and 14.55 g of pure water were added to the mixture, to provide a first composition.

2.36 g of tetraethyl orthosilicate (TEOS), 30 g of methanol, 50 g of ethanol, 12 g of n-butanol and 4 g of pure water were mixed, and 0.5 g of nitric acid was added to the mixture. Then, the resultant mixture was reacted for 24 hours at room temperature, to obtain a second composition.

While rotating a cleaned glass substrate at 80 rpm, the first composition was deposited on the substrate and rotated for 60 seconds until the composition was completely coated on the substrate. Then, the rotation rate of the glass substrate was increased to approximately 190 rpm, and the glass substrate was rotated for 80 seconds at 190 rpm, and then dried.

Thereafter, while rotating the substrate on which the first composition was coated, the second composition was deposited onto the substrate and rotated for 15 seconds. Then, the rotation speed was increased to approximately 150 rpm and the rotation was continued for 110 seconds, and then the resultant was dried.

The dried substrate was heated at approximately 200° C. for 30 minutes, to complete a transparent conductive layer.

The transparent conductive layer formed by the above steps had a sheet resistance of 170 Ω/□, a transmittance of about 0.8, a reflectivity of about 0.6.

EXAMPLES 2~5

Transparent conductive layers were formed by the same method as Example 1, except the content of the polypyrrolidone solution was varied to 0.15 g, 0.2 g, 0.25 g and 0.3 g.

The sheet resistance of the transparent conductive layers formed by Examples 2~5 was 550, 300, 170 and 240 Ω/□, respectively.

EXAMPLES 6~7

Transparent conductive layers were formed by the same method as Example 1, except the heating temperature was controlled to 180° C. and 190° C., respectively.

The sheet resistance of the transparent conductive layers formed by Examples 6~7 was 300 and 220 Ω/□, respectively.

EXAMPLE 8

A transparent conductive layer was formed by the same method as Example 1, except the first composition was formed of 0.45 g of silver (Ag), 0.25 g of polyvinylpyrrolidone solution, 14.55 g of pure water, 70 g of methanol, 55 g of 2-methoxyethanol and 10 g of PGM.

EXAMPLE 9

A transparent conductive layer was formed by the same method as Example 1, except the first composition was formed of 0.38 g of Ag, 0.21 g of polyvinylpyrrolidone solution, 12.12 g of pure water, 72.5 g of methanol, 55 g of 2-methoxyethanol and 10 g of PGM.

EXAMPLE 10

A transparent conductive layer was formed by the same method as Example 1, except the first composition was formed of 0.30 g of Ag, 0.17 g of polyvinylpyrrolidone solution, 9.70 g of pure water, 75 g of methanol, 55 g of 2-methoxyethanol and 10 g of PGM.

The transparent conductive layers formed by Examples 8~10 have 170, 1,000 and 5,000 Ω/□ of sheet resistance, respectively.

EXAMPLE 11

A transparent conductive layer was formed by the same method as Example 1, except the first composition was prepared by the following method.

20 g of pure water and 0.25 g of polyvinylpyrrolidone solution were mixed and stirred for about 1 hour, and then 0.45 g of Ag particles were added to the mixture. A mixed solution containing 25 g of methanol, 44 g of ethanol, 44.5 g of isopropylalcohol, 11.0 g of PGM and 0.36 g of colloidal silica was added to the resultant mixture, and then stirred for about 1 hour, to obtain a transparent conductive layer.

EXAMPLE 12

A transparent conductive layer was formed by the same method as Example 11, except 0.53 g of antimony tin oxide (ATO) was used instead of 0.36 g of colloidal silica.

EXAMPLE 13

A transparent conductive layer was formed by the same method as Example 11, except that 0.6 g of indium tin oxide was used instead of 0.36 g of colloidal silica.

The refractive index and reflectivity of each transparent conductive layer formed by Examples 11~13 are shown in Table 1.

TABLE 1

| class | refractive index (500 nm) | reflectivity (500 nm) |
|---|---|---|
| Example 11 | 1.72 | 1.23 |
| Example 12 | 1.79 | 1.21 |
| Example 13 | 1.82 | 1.38 |

EXAMPLE 14

A transparent conductive layer was formed by the same method as Example 1, except 0.0172 g of antimony tin oxide (ATO) was added to the first composition.

EXAMPLE 15

A transparent conductive layer was formed by the same method as Example 1, except the first composition was prepared by the following method.

80 g of methanol, 55 g of 2-methoxyethanol and 0.25 g of polyvinylpyrrolidone were mixed and stirred for 1 hour. Then, 0.45 g of Ag particles having 20 nm in average particle diameter, 0.086 g of ATO and 14.55 g of pure water were added to the mixture, to obtain a first composition.

The transparent conductive layers formed by Examples 14~15 were 2,000 and 900 Ω/□ of sheet resistance, respectively.

As described above, the transparent conductive layers having improved conductivity can be formed at a low sintering temperature near 200° C. by Examples 1~15.

The present invention provides the following effects.

First, due to its very low sheet resistance, the transparent conductive layer can be applied to a large monitor of 17" or more with satisfying the restriction by the TCO.

Second, the method for forming the transparent conductive layer according to the present invention does require neither a high-temperature sintering process nor a vacuum device, thereby lowering manufacturing costs.

Third, the transparent conductive layer is formed by a low-temperature sintering process, so that it can be applied to a substrate having low heat-resistance.

The transparent conductive layer according to the present invention, having the above-described characteristics, can be used effectively in a display, particularly, as an electromagnetic wave shielding layer or anti-static layer for a CRT. Also, the transparent conductive layer can be used as an electromagnetic wave shielding layer of home appliances, a power supplying transparent electrode, etc.

What is claimed is:

1. A conductive composition comprising metal ($M_1$) particles, a binding agent, and a solvent, wherein the metal ($M_1$) particles have an average particle diameter of 10~30 nm and are at least one selected from the group consisting of gold (Au), silver (Ag), platinum (Pt), copper (Cu), nickel (Ni), lead (Pb), cobalt (Co), rhodium (Rh), ruthenium (Ru), palladium (Pd), and tin (Sn), and wherein the binding agent is at least one compound selected from the group consisting of polypyrrole, polyvinylpyrrolidone, and polyvinylalcohol.

2. A conductive composition comprising metal ($M_1$) particles, a binding agent, and a solvent, wherein the metal ($M_1$) particles have an average particle diameter of 10~30 nm and are at least one selected from the group consisting of gold (Au), silver (Ag), platinum (Pt), copper (Cu), nickel (Ni), lead (Pb), cobalt (Co), rhodium (Rh), ruthenium (Ru), palladium (Pd), and tin (Sn), and wherein the binding agent is at least one compound selected from the group consisting of polypyrrole, polyvinylpyrrolidone, polyvinylalcohol, and a silicon alkoxide oligomer, wherein the content of the binding agent is 0.0333~0.32 wt % based on the total weight of the composition.

3. A conductive composition comprising metal ($M_1$) particles, a binding agent, and a solvent, wherein the metal ($M_1$) particles have an average particle diameter of 10~30 nm and are at least one selected from the group consisting of gold (Au), silver (Ag), platinum (Pt), copper (Cu), nickel (Ni), lead (Pb), cobalt (Co), rhodium (Rh), ruthenium (Ru), palladium (Pd), and tin (Sn), and wherein the binding agent is polypyrrole.

4. The composition of claim 3, further comprising metal oxide particles.

5. The composition of claim 4, wherein the mixing ratio of the metal particles and metal oxide particles is 2.5:1~30:1.

6. The composition of claim 4, wherein the metal oxide particles are at least one compound selected from the group consisting of indium tin oxide (ITO), tin oxide ($SnO_2$), indium oxide ($In_2O_3$), titanium oxide ($TiO_2$), antimony tin oxide (ATO), silicon oxide ($SiO_2$), and zirconium oxide ($ZrO_2$).

7. The composition of claim 3, wherein the content of the metal particles is 0.2~1.0 wt % based on the total weight of the composition.

8. The composition of claim 3, wherein the content of the binding agent is 0.0333~0.332 wt % based on the total weight of the composition.

9. The composition of claim 3, wherein the mixing ratio of the binding agent and the metal particles is 1:10~1:1.82.

10. A conductive composition comprising metal ($M_1$) particles, a binding agent, and a solvent, wherein the metal ($M_1$) particles have an average particle diameter of 10~30 nm and are at least one selected from the group consisting of gold (Au), silver (Ag), platinum (Pt), copper (Cu), nickel (Ni), lead (Pb), cobalt (Co), rhodium (Rh), ruthenium (Ru), palladium (Pd), and tin (Sn), and wherein the binding agent is polyvinylpyrrolidone.

11. The composition of claim 10, further comprising metal oxide particles.

12. The composition of claim 11, wherein the mixing ratio of the metal particles and metal oxide particles is 2.5:1~30:1.

13. The composition of claim 11, wherein the metal oxide particles are at least one compound selected from the group consisting of indium tin oxide (ITO), tin oxide ($SnO_2$), indium oxide ($In_2O_3$), titanium oxide ($TiO_2$), antimony tin oxide (ATO), silicon oxide ($SiO_2$) and zirconium oxide ($ZrO_2$).

14. The composition of claim 10, wherein the content of the metal particles is 0.2~1.0 wt % based on the total weight of the composition.

15. The composition of claim 10, wherein the content of the binding agent is 0.0333~0.332 wt % based on the total weight of the composition.

16. The composition of claims 10, wherein the mixing ratio of the binding agent and the metal particles is 1:10~1:1.82.

17. A conductive composition comprising metal ($M_1$) particles, a binding agent, and a solvent, wherein the metal ($M_1$) particles have an average particle diameter of 10~30 nm and are at least one selected from the group consisting of gold (Au), silver (Ag), platinum (Pt), copper (Cu), nickel (Ni), lead (Pb), cobalt (Co), rhodium (Rh), ruthenium (Ru), palladium (Pd), and tin (Sn), and wherein the binding agent is polyvinylalcohol.

18. The composition of claim 17, further comprising metal oxide particles.

19. The composition of claim 18, wherein the mixing ratio of the metal particles and metal oxide particles is 2.5:1~30:1.

20. The composition of claim 18, wherein the metal oxide particles are at least one compound selected from the group consisting of indium tin oxide (ITO), tin oxide ($SnO_2$), indium oxide ($In_2O_3$), titanium oxide ($TiO_2$), antimony tin oxide (ATO), silicon oxide ($SiO_2$), and zirconium oxide ($ZrO_2$).

21. The composition of claim 17, wherein the content of the metal particles is 0.2~1.0 wt % based on the total weight of the composition.

22. The composition of claim 17, wherein the content of the binding agent is 0.0333~0.332 wt % based on the total weight of the composition.

23. The composition of claims 17, wherein the mixing ratio of the binding agent and the metal particles is 1:10~1:1.82.

* * * * *